US008777122B2

(12) United States Patent
Bösterling et al.

(10) Patent No.: US 8,777,122 B2
(45) Date of Patent: Jul. 15, 2014

(54) SYSTEM FOR FIXING A RAIL ONTO A FOUNDATION AND SUPPORT PLATE FOR SUCH A SYSTEM

(75) Inventors: Winfried Bösterling, Neuenrade (DE); Adrian Bednarczyk, Lüdencheid (DE)

(73) Assignee: Vossloh-Werke GmbH, Werdohl (DE)

( * ) Notice: Subject to any disclaimer, the term of this patent is extended or adjusted under 35 U.S.C. 154(b) by 114 days.

(21) Appl. No.: 13/583,364

(22) PCT Filed: Mar. 2, 2011

(86) PCT No.: PCT/EP2011/053077

§ 371 (c)(1),
(2), (4) Date: Nov. 2, 2012

(87) PCT Pub. No.: WO2011/110456

PCT Pub. Date: Sep. 15, 2011

(65) Prior Publication Data

US 2013/0168460 A1 Jul. 4, 2013

(30) Foreign Application Priority Data

Mar. 12, 2010 (EP) ..... 10156436

(51) Int. Cl.
*E01B 3/00* (2006.01)

(52) U.S. Cl.
USPC ..... 238/287; 238/264; 238/351

(58) Field of Classification Search
USPC ..... 238/264, 280, 283, 351, 258, 259, 290, 238/265, 266, 274, 287
See application file for complete search history.

(56) References Cited

U.S. PATENT DOCUMENTS

| | | | | |
|---|---|---|---|---|
| 4,715,533 | A * | 12/1987 | Bucksbee et al. | 238/283 |
| 6,860,433 | B2 * | 3/2005 | Dietze et al. | 238/287 |
| 7,063,269 | B2 * | 6/2006 | Molyneux | 238/287 |
| 7,533,829 | B2 * | 5/2009 | Osler et al. | 238/264 |
| 7,648,080 | B2 * | 1/2010 | Hohne et al. | 238/351 |
| 7,992,796 | B2 * | 8/2011 | Bednarczyk | 238/264 |
| 8,297,528 | B2 * | 10/2012 | Meyer | 238/264 |
| 2004/0035946 | A1 * | 2/2004 | Dietze et al. | 238/287 |
| 2008/0093472 | A1 * | 4/2008 | Hohne et al. | 238/351 |
| 2011/0068185 | A1 * | 3/2011 | Bosterling et al. | 238/283 |

(Continued)

FOREIGN PATENT DOCUMENTS

| | | | |
|---|---|---|---|
| DE | 19745326 | A1 | 4/1999 |
| DE | 10148411 | A1 | 4/2003 |
| WO | 2005124025 | A1 | 12/2005 |
| WO | 2010017843 | A1 | 2/2010 |

*Primary Examiner* — Jason C Smith
(74) *Attorney, Agent, or Firm* — The Webb Law Firm

(57) ABSTRACT

A system for fixing a rail onto a foundation and a support plate intended for such a system. The system comprises a guide plate, a spring element which can be clamped against the foundation by means of a clamping element, sits on the guide plate and in the final mounted system with its free spring arm exerts a retaining force on a rail foot of the rail, and a support plate which is arranged to compensate for height differences between the guide plate and the foundation concerned. The system proposes dividing the support into two parts along a joint line which runs, starting from the one long side of the support plate aligned transverse to the rail to be fixed, at a distance from the one short side to the passage opening and from there intersecting the passage opening in the direction of the short side of the support plate.

12 Claims, 5 Drawing Sheets

(56) References Cited

U.S. PATENT DOCUMENTS

2011/0204154 A1* 8/2011 Boesterling et al. ..... 238/264
2013/0153671 A1* 6/2013 Bosterling et al. ..... 238/349
2013/0168460 A1* 7/2013 Bosterling et al. ..... 238/287
2013/0206854 A1* 8/2013 Bosterling et al. ..... 238/287
2013/0240635 A1* 9/2013 Bosterling et al. ..... 238/349

* cited by examiner

SYSTEM FOR FIXING A RAIL ONTO A FOUNDATION AND SUPPORT PLATE FOR SUCH A SYSTEM

BACKGROUND OF THE INVENTION

1. Field of the Invention

A system for fixing a rail onto a foundation, which includes a guide plate which guides the rail to be fixed on its long side, a spring element which can be clamped against a foundation by means of a clamping element and which sits on the guide plate and when the system is finally mounted, with a free spring arm exerts a retaining force on a rail foot of the rail to be fixed, and has a support plate which extends transverse to the rail to be fixed over the width of the guide plate and which is arranged to compensate for height differences between the guide plate and the foundation, wherein the support plate has a rectangular base form and includes a passage opening for the clamping element used to clamp the spring element. A support plate for such a system is also disclosed.

2. Description of Related Art

Such supports are used firstly to support other components of the fixing system to the foundation over a large area. Secondly it is used for height adjustment when the height level of the respective mounting surface of the foundation between two adjacent fixing points deviates beyond a tolerance range. If an unacceptable height deviation is found, it can be compensated by two or more support plates of different thickness being pushed below the rail concerned. In principle the requirement for subsequently inserting or changing the support plates is problematic here.

To eliminate this problem, DE 197 45 326 A1 discloses a support plate for a rail fixing system of the type described initially in which at least one of two diagonally opposed openings for the passage of clamping elements to be screwed into the foundation for clamping the spring element concerned are formed as a slot open towards the long side of the support plate. Even if it is possible in this way to push the support plate subsequently under the other components of a rail fixing system without having to completely release the clamping element, this design of a support plate in practice has the disadvantage that it must be very long to receive the slots necessary for the clamping element concerned. This applies in particular if the passage openings for the clamping elements, in contrast to the provision with the known support plate, are arranged centrally in relation to the longitudinal axis of the support plate. The layer of the fixing system above is not supported in the area of the large slot, with the consequence that the material of the layer concerned—irrespective of its properties—presses into the slot under the heavy loads occurring when a rail vehicle travels over the rails. This can lead to premature wear on the layer concerned or the support plate in the area of the slot. This danger is particularly critical if the rail is supported flexibly via an elastic layer lying on the support plate.

SUMMARY OF THE INVENTION

In the context of the prior art described above, an object of the invention was to create a system of the type specified initially for fixing a rail, which system firstly guarantees a sufficiently long life of the components and the material layers lying on the support plate, and in which secondly subsequent mounting or exchange of the support plate is easily possible.

Also a support plate is created which can easily be installed subsequently and at the same time has optimum usage properties both with regard to its support function and with regard to minimised wear of the material of the layer or components lying thereon in practical use.

In relation to the system for fixing a rail, this object is achieved by the invention in that such a system is formed in the manner as described herein.

With reference to the support plate, the solution to the task described above according to the invention is to form a support plate as described herein.

Advantageous embodiments of the invention are given in the dependent claims and are explained below individually.

The invention provides that in a fixing system of the type described initially, the support plate is divided into two parts along a joint line which leads from the one of the long sides of the support plate aligned transverse to the rail to be fixed, at a distance from its short side, to the passage opening and from there is guided intersecting the passage opening in the direction of the short side of the support plate.

According to the invention, therefore, the support plate is divided into two parts abutting each other, of which at least one part extends along the short side of the support plate over its entire width and on which a section extending in the longitudinal direction of the support plate is formed, which receives at least partly the passage opening for the clamping element concerned. The other part of the support plate fills the section cut out of the first part, limiting the part of the passage opening of the support plate which is not surrounded by the first part.

A first advantage of the design of a support plate according to the invention is that the two parts of the support plate can easily be mounted subsequently on an existing fixing system, in that viewed in the longitudinal direction of the rail one part is inserted from the one side and the other part from the other side below the other components of the fixing system already mounted. As soon as the two parts of the support plate are fully inserted, they closely surround the clamping element so that despite the division of the support plate, the same continuous support, over a large area, of the components and material layers resting on the support plate is guaranteed as with an undivided support plate.

A further advantage important in practice of the design of a support plate according to the invention is that it is undivided at least in the area of its one short side. In this way it is guaranteed that the components and material layers resting on the support can be securely supported even if very high pressures are exerted on the support plate or if the foundation has a degree of flexibility. The section of the one part of the support plate extending over the short side ensures that the support plate retains its form even under heavy load and its two parts cannot be pushed apart.

The design of a support plate according to the invention therefore provides a system for fixing a rail which, because of the even support of its components on the solid foundation, guarantees an optimum long life and in which, however, subsequent mounting or change of the support plate is easily possible.

An embodiment of the invention particularly important in practice comprises a fixing system of the type according to the invention with two guide plates, each of which is arranged on one of the long sides of the rail to be fixed, the support plate extending below the two guide plates.

The joint line in which the two parts of the support plate abut each other is optimally guided so that the two parts of the support plate are formed point-symmetrical. This has the advantage that a section extending over the entire width of the support plate is present on both short sides, further increasing the security against the support plate moving apart under heavy load.

In this context it is particularly advantageous if the two parts of the support plate are formed identical, allowing a particularly economic and simple production of the support plate.

A further embodiment of the invention which is advantageous in practical use is characterised in that the support plate, on at least one short side, has a shoulder via which the guide plate allocated to this short side is supported against a support shoulder provided on the foundation. This shoulder not only protects the parts of the fixing system lying on it against direct, possibly abrasive contact with a corresponding shoulder present on the foundation, but additionally helps prevent the two parts of the support plate from being pushed apart under heavy load.

For the reasons explained above, the large area support of the layers or components lying on the support plate achieved by the embodiment of a rail fixing system according to the invention is particularly advantageous if it comprises an elastic layer which lies on the support plate and on which the rail to be fixed is elastically supported in the final mounted state.

A favourable course of the joint line, in particular with a point-symmetrical design of the parts of the support plate according to the invention, arises if the joint line, coming from one long side, starting from the passage opening, is guided kinked in the direction of the other long side.

An optimum course of the joint line, firstly with regard to the joinability of the two parts of the support plate and secondly with regard to the design of the section of the one part extending over the short side of the support plate, arises if said line is guided, starting from one long side, up to the passage opening at a distance from the short side allocated to the passage opening, which distance corresponds to the minimum distance of the respective passage opening from its allocated short side.

The latter applies in particular if the support plate has two passage openings and the joint line, beginning at the one long side, runs intersecting the first passage opening through to the other passage opening, intersects this and then runs at a distance from the short side allocated to the second passage opening, up to the other long side of the support plate opposite the first long side.

A permanently secure, positionally correct allocation of the parts of the support plate can be further supported if on the parts of the support plate elements such as correspondingly formed protrusions and recesses are formed which cooperate by form fit when the support plate is in the assembly position.

The material costs required for production of the guide plate and consequently the weight of a support plate according to the invention can be minimised if recesses are moulded in the underside of the support plate. To stiffen the guide plate, reinforcing ribs can be formed where applicable between the recesses.

As well as the main possibility considered here of height adjustment by means of a support plate according to the invention pushed below the other components of the system according to the invention, an additional possibility of height adjustment between two adjacent fixing points of the rail lies for example in that the height of the rail foot above the support plate is varied by means of one or more intermediate layers which are laid between the rail foot and the support plate. If at the same time the support plate remains supported directly on the support plate or the foundation, at the same time as changing the distance between the rail foot and foundation or support plate, the retaining force applied to the rail foot by the spring element in the final mounted state also changes. This change can be compensated simply in that an adapter piece is attached to the free end of the spring arm of the spring element acting on the rail foot, and is mounted pivoting about a rotary axis on the end section of the spring arm and has at its periphery at least two contact surface sections, one of which, depending on the rotary position of the adapter piece, in each case lies against the rail foot, wherein the one contact surface section of the adapter piece has a greater distance from the rotary axis of the adapter piece than the other contact surface section. According to the invention in this case the adapter piece is therefore formed and arranged on the spring arm of the spring element of a system according to the invention such that it can be adjusted in the manner of an eccentric element in order to set, with regard to pretension of spring element and force exerted by the spring element, the essential distance between the free end of the spring element and the surface of the rail foot. Thus the distance and with this the retaining force exerted by the spring element on the rail can be increased such that the adapter piece is supported on the rail foot via the contact surface section which has a great distance from the respective free end of the spring arm of the spring element. Consequently the effective retaining force can be reduced in that the adapter piece is turned so that it is supported on the rail foot via a contact surface section arranged at the smaller distance from the free end of the allocated spring arm.

If, in the case of use of an adapter piece of the type explained initially, it is to be ensured with particularly simple means that the adapter piece and with it the spring element coupled thereto securely retain their respective pre-assembly position even under the loads occurring in practice until final installation is performed, this can be achieved in that a guide plate is provided which has a contact surface on its face allocated to the rail foot and on its free top side a sliding surface limiting the contact surface and rising in the direction of the contact surface, via which the adapter piece can be moved from a pre-assembly position, established by a stop formed on the guide plate, in which it sits with its selected contact surface section on the guide plate, into an assembly position in which it sits with the contact surface section on the foot of the rail to be fixed, in order to transfer the elastic retaining force exerted by the spring element to the rail foot. The spring element is also arranged on the guide plate, on which, to this end, forming elements are usually moulded which guide the spring element and secure its position. In such a guide plate formed according to the invention, the adapter piece is pressed against the stop in the pre-assembly position as a result of the retaining force applied to it which is exerted by the spring element coupled to the adapter piece via the respective spring arm. In order to be moved into the final assembly position, the adapter piece must therefore be pushed, starting from the stop, obliquely upwards on the slide surface with the consequence that the spring forces exerted by the spring element increase and an additional force load must be overcome. As this cannot be achieved without targeted force applied externally, the adapter piece and with it the spring element are automatically held in the pre-assembly position until the final assembly process begins.

BRIEF DESCRIPTION OF THE DRAWINGS

The invention is now explained below with reference to a drawing showing an exemplary embodiment in more detail. The drawings show schematically.

DETAILED DESCRIPTION OF THE INVENTION

Figure 1:
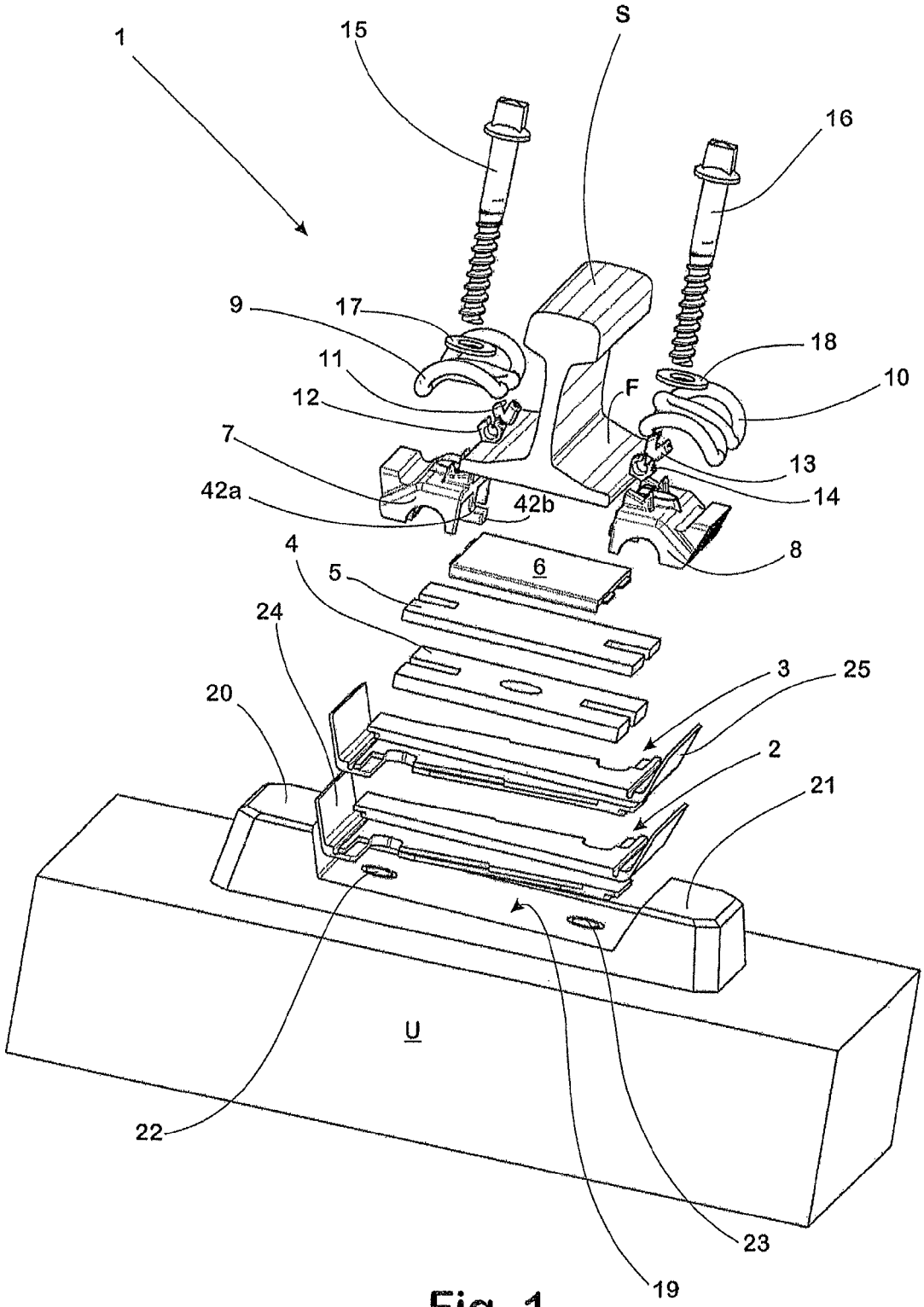
FIG. 1 a system for fixing a rail in an exploded view.
Figure 2:
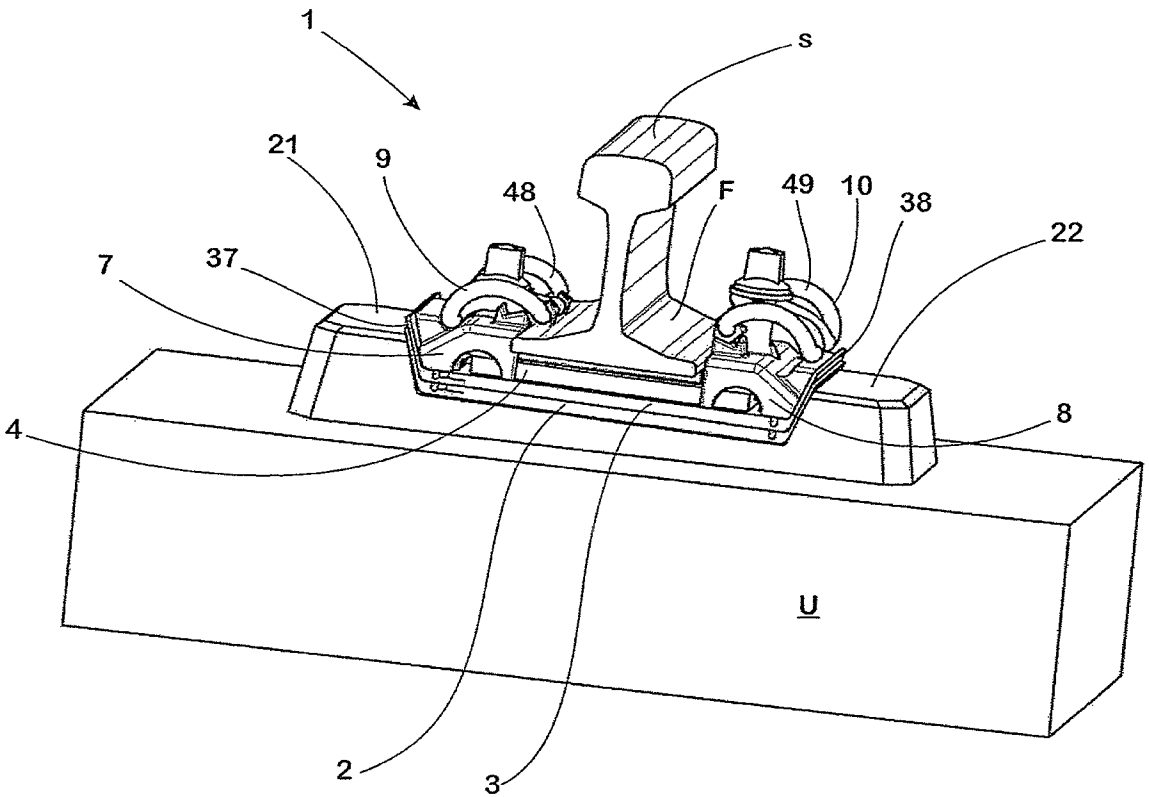
FIG. 2 the system in final assembled state in a perspective view.
Figure 3:
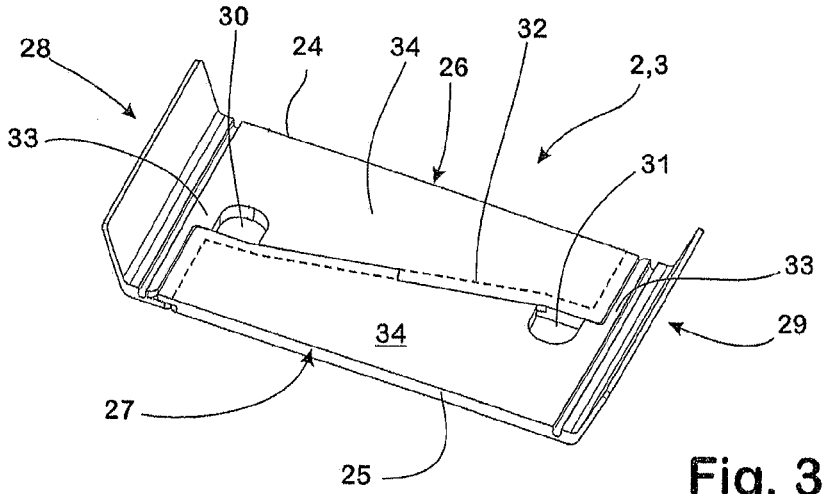
FIG. 3 a support plate in a perspective view from above.
Figure 4:
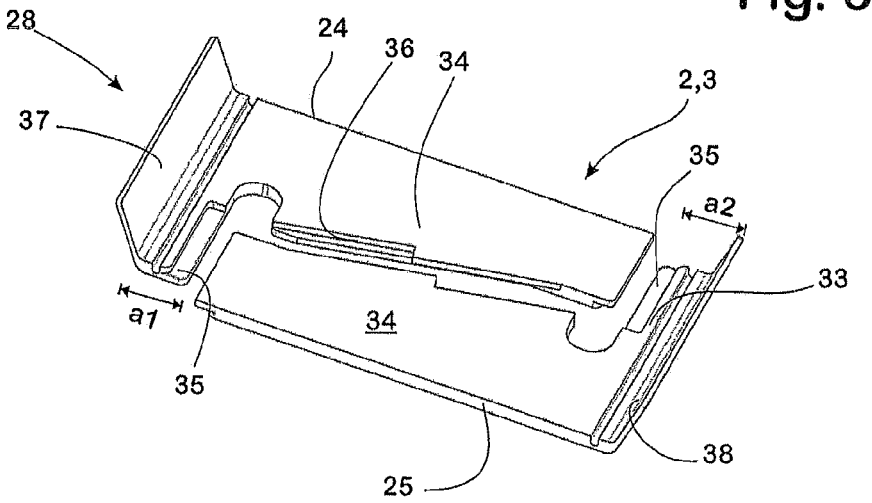
FIG. 4 the parts of the support plate in a perspective view from above.
Figure 5:
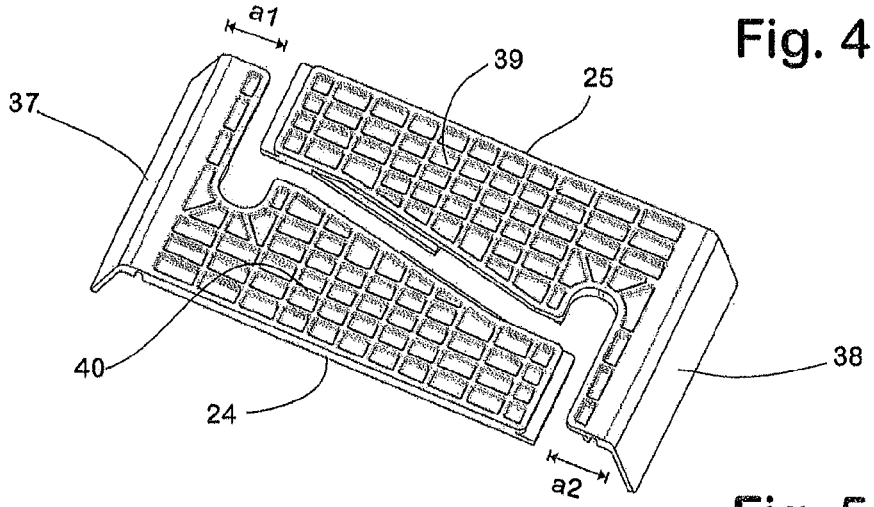
FIG. 5 the parts of the support plate in a perspective view from below.
Figure 6:
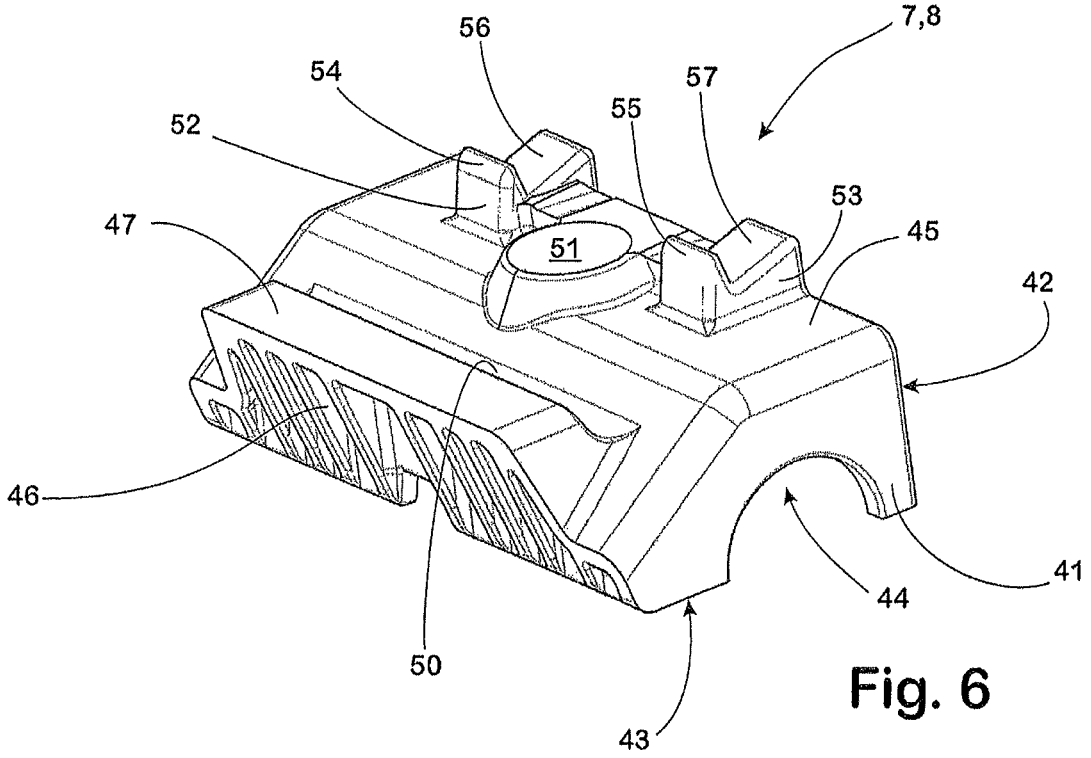
FIG. 6 a guide plate in a perspective view.
Figure 7:
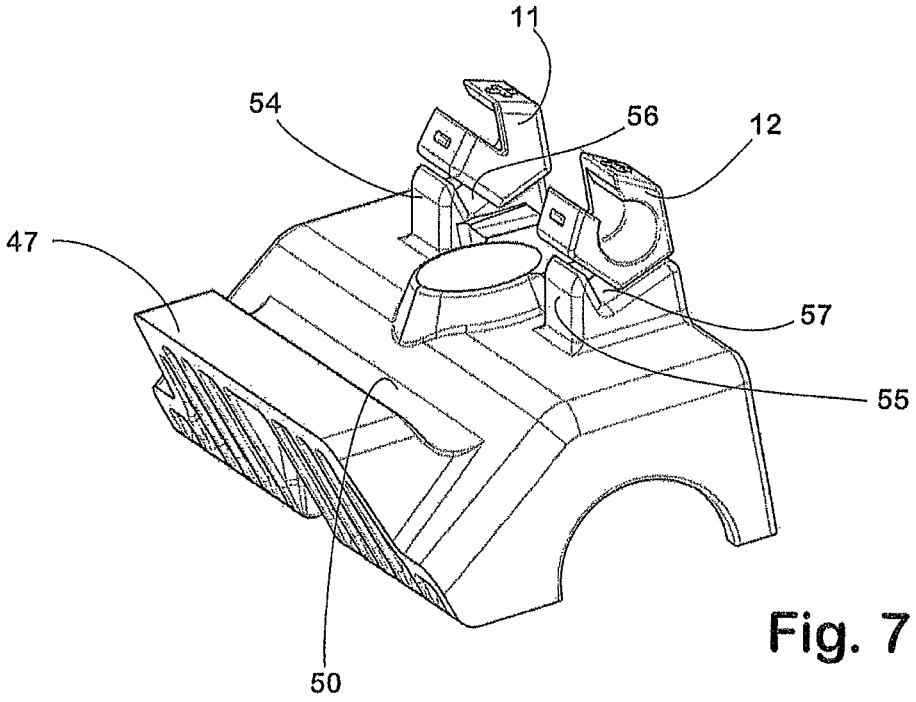
FIG. 7 the guide plate with adapter pieces thereon.
Figure 8:
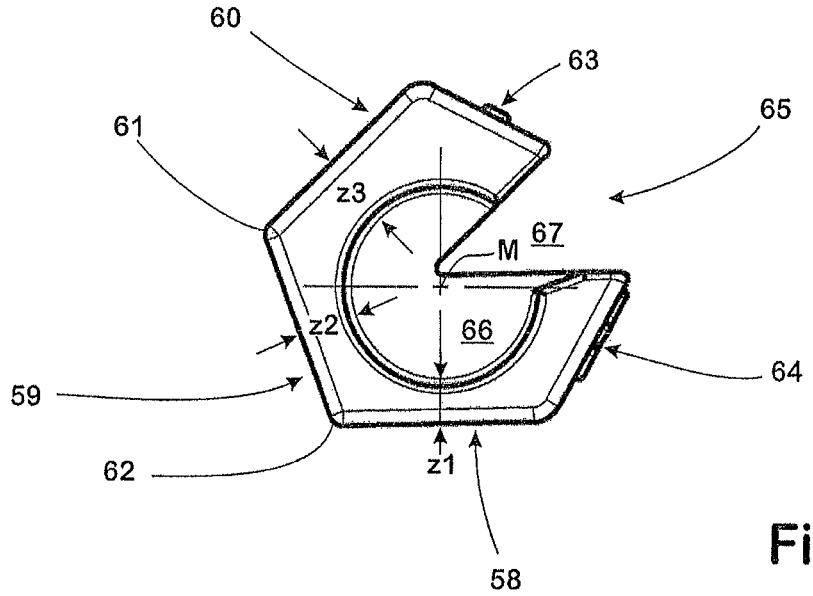
FIG. 8 an adapter piece in a front view.
Figure 9:
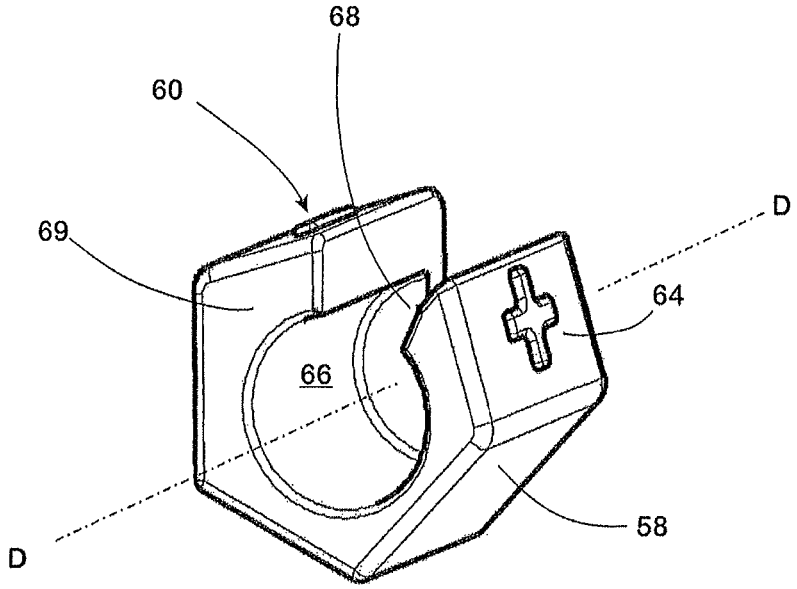
FIG. 9 the adapter piece in a perspective view.

The system 1 for fixing a rail S on a solid foundation U formed for example by a concrete sleeper or concrete plate comprises a first support plate 2, a second support plate 3, an elastic intermediate layer 4, a pressure distribution plate 5, a height adjustment plate 6, a first guide plate 7, a second guide plate 8, two spring elements 9, 10 formed as ω-shaped clamps, two pairs of adapter pieces 11-14 and two clamping elements 15, 16 formed as clamping screws which act each via a washer 17, 18 on the centre loop of the spring elements 9, 10.

The fixing system 1 sits in a holder 19 moulded as one piece on the solid foundation U and limited on each of its short sides running parallel to rail S by a support shoulder 20, 21. In each contact surface of the holder 19 present between the support shoulders 20, 21 and adjacent to the support shoulders 20, 21, a plastic peg 22, 23 is inserted in the foundation U. Screwed into each plastic peg 22, 23 on assembly of the system 1 is one of the clamping elements 15, 16 to clamp the spring elements 9, 10.

The support plates 2, 3 each composed of two point-symmetrically shaped parts 24, 25 have a rectangular form with two parallel long sides 26, 27 and two likewise parallel short sides 28, 29, and extend over the entire width of the holder 19. In the support plates 2, 3 two passage openings 30, 31 are formed, each of which is positioned adjacent to one of the short sides 28, 29 and centrally between the long sides 26, 27 such that when the support plate 2, 3 is inserted in the holder 19, they align with the opening of the plastic peg 22, 23 inserted in the foundation U.

The joint line 32 at which the two parts 24, 25 of the support plates 2, 3 meet runs, starting from the edge of one long side 26, first parallel to the edge of the short side 28 allocated to the first passage opening 30, wherein the distance a1 from the edge concerned corresponds to the shortest distance between the edge of the passage opening 30 and the edge of the short side 28. This section 28 of the joint line is guided up to the passage opening 30 in order there to bend substantially at right angles to the edge of the short side 28 and to be guided, intersecting the passage opening 30 at its edge allocated to the long side 26, in the direction of the other passage opening 31. As soon as it has passed the passage opening 30, the joint line 32 bends in the direction of the other long side 27 so that it meets the passage opening 31 on its side allocated to the long side 27. There the joint line 32 again bends so that it runs substantially at right angles, intersecting the passage opening 31 at its edge allocated to the long side 27, to the edge of the other short side 29 until it has passed the passage opening 31. At this point the joint line 32 assumes a course aligned parallel to the edge of the short side 29 until it reaches the edge of the long side 27. The distance a2 of the section of the joint line 32 running parallel to the edge of the short side 29 corresponds to the smallest distance between the edge of the passage opening 31 and the edge of the short side 29.

With this course of joint line 32, the two parts 24, 25 of the support plate 2, 3 each have a section 33 extending over the entire width B of their short sides 28, 29. From this section 33 projects a further section 34 which in each case borders one of the long sides 26, 27 of the support plate 2, 3 concerned and the width of which in the area adjacent to section 33 corresponds to half the width B of the support plate plus half the diameter of the passage opening 30, 31 formed therein, whereas its width in the area of its free end is equal to half the width B of the respective support plate 2, 3 less half the diameter of the other passage opening 31, 30.

On the allocated ends of the parts 24, 25 of the support plates 2, 3, abutting in the joined state, correspondingly shaped protrusions and recesses 35, 36 are formed, which in the assembled state overlap each other by form fit and thus in the installation state prevent the parts 24, 25 from lifting in a direction perpendicular to the foundation U even under heavy load.

On each of the short sides 28, 29 of the support plates 2, 3 a shoulder 37, 38 is formed, which in the installation position are aligned pointing upwards away from sections 33, 34 and extend over the entire width B of the respective support plate 2, 3. The shoulders 37, 38 are formed and aligned such that they lie flush on the support shoulders 20, 21 in the state inserted in the holder 19.

To minimise their weight and save material, in the area of sections 33, 34 in the underside of parts 24, 25 regularly arranged recesses 39 are formed, between which ribs 40 are arranged, which in the installation state stand on the contact surface of the holder 19.

To achieve the height adjustment necessary in the present exemplary embodiment, the two support plates 2, 3 are arranged stacked on each other in the holder 19.

On any subsequent installation of the support plates 2, their parts 24, 25 are each pushed from one long side of the holder 19 below the other components of the system 1 until they abut each other and their protrusions and rebates 35, 36 engage. In this position the parts with their passage openings 30, 31 surround the screw shafts of the clamping elements 15, 16 with close tolerance so that despite the division of the support plates 2, 3, a maximum support area for the components of system 1 lying above them is guaranteed.

On the top support plate 3 lies the elastic intermediate layer 4 which guarantees the necessary flexibility of the rail fixing formed by the system 1.

The load absorbed by the rail S on passage of a rail vehicle not shown here is distributed over a large area onto the intermediate layer 4 by means of the pressure distribution plate 5 lying on the intermediate layer 4.

The intermediate layer 4 and the pressure distribution plate 5 each have slots on their short sides in which fit the clamping elements 15, 16 in the final assembled state.

The width of the intermediate layer 4 and the pressure distribution plate 5 is in each case less than the width B of the support plates 2, 3 so that along the long sides 26, 27 of the support plates 2, 3 is a short edge strip on which the guide plates 7, 8 stand with their side feet 41, 42 allocated to the rail foot F.

In order to compensate for any further height tolerances, on the pressure distribution plate 5 lies the height adjustment plate 6 on which the rail S stands with its rail foot F.

The guide plates 7, 8 made from a reinforced plastic are identical in structure. Each of them in the known manner is arranged on one of the long sides of the rail S in order to guide the rail S at the side. At the same time the guide plates 7, 8 also in a known manner serve as a bearing for the spring elements 9, 10 seated thereon.

On their face allocated to the rail foot F the guide plates 7, 8 have a contact surface 42 with which in the final mounted state they lie sideways against the rail foot F. The contact surface 42 is interrupted by two openings which lead to a recess 44 formed starting from the underside 43 of the guide plates 7, 8. In the area of the recess 44 reinforcing ribs not visible here are formed, which carry the roof 45 of the guide plates 7, 8 with spring elements 9, 10 clamped thereon.

At the side facing away from the contact surface 42, on these guide plates 7, 8 a support section 46 with recesses and reinforcement ribs is formed, on the free top side of which a flat support surface 47 is formed. On this support surface 47 in the preassembly position sit the transition sections of the spring elements 9, 10 which connect the spring arms 48, 49 of the spring elements 9, 10 with their centre loop. At the same time the support section 46 limits a channel 50 formed in the top of the guide plates 7, 8 and extending parallel to the contact surface 42, in which the transition sections of the spring elements 9, 10 sit in the final mounted position.

At a central point a passage opening 51 is formed in the roof 45 of the guide plates 7, 8, through which opening the screw shaft of the clamping element 15, 16 concerned is guided. The passage opening 51 is surrounded by a peripheral collar which firstly prevents the penetration of water into the opening 51 and secondly forms a guide for the central loop of the respective spring element 9, 10. On both sides of the passage opening 51 and at an even distance from this on the top of the guide plate 7, 8 a step 52, 53 is formed, which reaches to the front contact surface 42. The steps 52, 53 in the final mounted system firstly form a side guide for the centre loop of the respective allocated spring element 9, 10. Secondly a wedge-shaped recess is formed in the steps 52, 53 starting from the top. In this way, at the end of the steps 52, 53 allocated to the support section 46, an upright stop 54, 55 and a flat slide surface 56, 57 are formed. These slide surfaces 56, 57 rise continuously starting from the stop 54, 55 in the direction of the contact surface 42 until they reach the front edge of the respective stop 52, 53 allocated to the contact surface 42.

Between the openings formed in the contact surface 42, a centre post 42*a* is provided in the area of the contact surface 42, on the lower end of which post a protrusion 42*b* is formed, directed away from the respective guide plate 8, 9 at right angles to the contact surface 42. The protrusion 42*b* is positioned such that in the final mounted position it engages below the rail foot F. This safely prevents any lifting of the guide plates 8, 9 under the loads occurring in practice.

The spring elements 9, 10 formed as ω-shaped clamps each have on their spring arms 48, 49 a cranked end section which, in the final mounted system 1, is aligned substantially parallel to the rail S. One of the adapter pieces 11-14 is mounted on each end section, pivoting about a rotary axis D coinciding with the long axis of the end section concerned.

Viewed from their front, the adapter pieces 11-14 have a pentagonal form. On the peripheral surface of the adapter pieces 11-14 three equal-sized contact surface sections 58, 59, 60 are formed, directly adjacent to each other and separated in each case by an edge 61, 62. Next to the two outer contact surface sections 58, 60 are two marking sections 63, 64. These marking sections 63, 64 can carry markings which indicate the increase or reduction in spring tension associated with rotation in the direction concerned.

The marker sections 63, 64 are separated by a slot 65 which is formed in the adapter pieces 11-14 from the radial direction and extends to a holder 66 formed in the adapter pieces 11-14 from the one front face. The slot 65 intersects a triangular opening 67 in the base 68 of the holder 66 so that any moisture or vapours collecting in the holder 66 can escape from the holder 66 via the opening 67.

The centre point M of the circular opening in the holder 66 is arranged offset in relation to the centre point of the faces 69 of the adapter pieces 11-14 so that the first contact surface section 58 has a first distance z1, the second contact surface section 59 a second distance z2 and the third contact surface section 60 a third distance z3 from the centre point M of the holder 66, where z1<z2<z3. Distances z1 to z3 each differ for example by one millimeter.

The adapter pieces 11-14 consist of an electrically non-conductive plastic which has a degree of elasticity at least in its peripheral direction.

In the relaxed state, not applied to the allocated end section of the spring arms 48, 49, the holder 66 of the adapter pieces 11-14 has a diameter which is smaller by a slight amount than the also largely circular end sections of the spring arms 48, 49. When the end sections are pushed into place, the adapter pieces 11-14 are spread accordingly in the peripheral direction so that as a result of the return forces acting in the adapter pieces 11-14, they are held on the allocated end section by friction fit but rotatable with a slight force application. The adapter pieces 11-14 can easily be spread because of the slot 65 which thus not only prevents the collection of moisture in the adapter pieces 11-14 concerned but also facilitates the placing of the adapter pieces 11-14 on the respective end section of the spring arms 48, 49 and ensures their adequate elastic flexibility.

For pre-mounting of the system 1, first the support plate 3 is laid in the holder 19 of the foundation U. Then the elastic layer 4 is placed on the support plate 2 and the pressure distribution plate 5 on the elastic layer.

The guide plates 8, 9 are then positioned so that in each case one of them lies with its support section 46 on one of the shoulders 37, 38 which again are each supported on one of the support shoulders 20, 21 of the foundation U. The guide plates 8, 9 with their side feet 41, 42 surround the intermediate layer 4 and the pressure distribution plate 5 so that they stand on the support plate 3. The centre post 42*a* stands with its protrusion 42*b* in the slot of the intermediate layer 4 and the pressure distribution plate 5.

Then on the pressure distribution plate 5 is placed the height adjustment plate 6, the width of which corresponds to the clear distance between the guide plates 7, 8.

Then the spring elements 9, 10 with adapter pieces 11-14 attached thereto are placed onto the allocated guide plates 7, 8 so that their transition section sits on the support surface 47 of the respective support section 46. In this position the adapter pieces 11-14 are placed with their contact surface section 58-60 allocated to the sliding surface 56, 57 concerned on the respective sliding surface 56, 57 and held resting on the respective stop 54, 55. Then after the clamping elements 15, 16 are screwed through the passage opening 51 of the respective angle guide plate 7, 8 and the passage openings 30, 31 of the support plate 2 into the allocated plastic peg 22, 23, the system 1 is provisionally clamped in its preassembly position.

After the rail S has been positioned, the spring elements 9, 10 are pushed in the direction of rail S until the adapter pieces 11-14 sit on their allocated side of the rail foot F and the transition sections of spring elements 9, 10 sit in the channel 50 of the guide plates 7, 8. The adapter pieces 11-14 then slide up the slide surfaces 56, 57 until they have passed the front free edge of steps 52, 53 and sit on the rail foot F.

If it is found that, as a result of excessive or too small a height difference between the top of the rail foot F and the top of the respective guide plate 7, 8, one of the spring elements 9, 10 exerts an inadequate or excessive retaining force on the rail foot F, this can be compensated by twisting the adapter piece 11-14 allocated to the spring element 9, 10 about its respective rotary axis D so that the adapter piece 11-14 concerned is supported on the rail foot F via a contact surface section 58, 59, 60 with a smaller distance (reduction of retention force) or a greater distance (increase in retention force) from the rotary axis D running through the centre point M of the holder 66.

The adapter pieces 11-14 thus allow very fine adjustment of the retaining forces applied by the spring elements 9, 10. At the same time they isolate the spring elements 9, 10 from the rail S.

If it is found that the height of the fixing point obtained by the system 1 for the rail S as a whole is too low, subsequently the additional support plate 2 and where applicable further support plates can be mounted below the support plate 3 in the manner already described above.

The invention claimed is:

1. A system for fixing a rail onto a foundation comprising:

a guide plate for guiding the rail to be fixed on its long side, a spring element clamped against the foundation by a clamping element, the spring element sitting on the guide plate and when the system is finally mounted, with a free spring arm exerting a retaining force on a rail foot of the rail to be fixed, and a support plate extending transverse to the rail to be fixed over a width of the guide plate, the support plate arranged to compensate for height differences between the guide plate and the foundation, wherein the support plate has a rectangular base form and comprises a passage opening for the clamping element used to clamp the spring element, wherein the support plate is divided into two parts along a joint line guided starting from one long side of the support plate aligned transverse to the rail to be fixed, at a distance from the one short side, to the passage opening and from there intersecting the passage opening in the direction of the short side of the support plate.

2. The system according to claim 1, wherein it has two guide plates, one of which is arranged on the long side of the rail to be fixed, and where the support plate extends below both guide plates.

3. The system according to claim 1, wherein the parts of the support plate are identical.

4. The system according to claim 1, wherein the support plate on at least one short side has a shoulder via which the guide plate allocated to the at least one short side is supported against a support shoulder provided on the foundation.

5. The system according to claim 1, wherein the system further comprises an elastic layer lying on the support plate and on which the rail to be fixed is supported elastically in a final mounted state.

6. A support plate for a system formed according to claim 1 for fixing a rail onto a foundation, the support plate comprising a rectangular base form and a passage opening for a clamping element used for clamping spring elements, wherein the support plate is divided into two parts along a joint line which is guided from long side of the support plate aligned transverse to the rail to be fixed, at a distance from one short side to the passage opening and from there intersecting the passage opening in the direction of the other short side of the support plate.

7. The support plate according to claim 6, wherein the joint line coming from the one long side starting from the passage opening is kinked in the direction of the other long side.

8. The support plate according to claim 6 wherein the joint line, starting from the one long side, is guided up to the passage opening at a distance from the short side allocated to the passage opening, which distance corresponds to the smallest distance of the passage opening from its allocated short side.

9. The support plate according to claim 8, wherein the support plate has two passage openings and that the joint line, starting at the one long side, runs intersecting a first passage opening up to a second passage opening, intersects this and then runs at a distance from the short side allocated to the second passage opening up to the other long side opposite the first long side of the support plate.

10. The support plate according to claim 6, wherein moulded elements are formed on the parts of the support plate which cooperate by form fit in the support plate in its assembly position.

11. The support plate according to claim 6, wherein at least on one of the short sides of the support plate, a shoulder is formed which is pointing away from the contact surface with which the support plate lies on the foundation concerned in mounted position.

12. The support plate according to claim 6, wherein recesses are formed in the contact surface.

* * * * *